US009227771B2

(12) United States Patent
Ueda et al.

(10) Patent No.: US 9,227,771 B2
(45) Date of Patent: Jan. 5, 2016

(54) OPENER CAP

(71) Applicant: KEY COFFEE INC., Tokyo (JP)

(72) Inventors: Hiromitsu Ueda, Yokohama (JP); Masahiro Takenaka, Yokohama (JP); You Yamamori, Yokohama (JP); Kazuo Kawamata, Tokyo (JP); Takeshi Sou, Tokyo (JP); Syouzo Fujii, Tokyo (JP)

(73) Assignee: KEY COFFEE INC., Tokyo (JP)

( * ) Notice: Subject to any disclaimer, the term of this patent is extended or adjusted under 35 U.S.C. 154(b) by 8 days.

(21) Appl. No.: 14/346,932

(22) PCT Filed: Sep. 20, 2012

(86) PCT No.: PCT/JP2012/074010

§ 371 (c)(1),
(2) Date: Mar. 24, 2014

(87) PCT Pub. No.: WO2013/047309

PCT Pub. Date: Apr. 4, 2013

(65) Prior Publication Data

US 2014/0224801 A1 Aug. 14, 2014

(30) Foreign Application Priority Data

Sep. 28, 2011 (JP) ..... 2011-211765

(51) Int. Cl.

| | |
|---|---|
| ***B65D 17/44*** | (2006.01) |
| ***B65D 51/22*** | (2006.01) |
| ***B65D 17/50*** | (2006.01) |
| ***B67B 7/00*** | (2006.01) |
| ***B65D 17/00*** | (2006.01) |

(52) U.S. Cl.

CPC ..... *B65D 51/228* (2013.01); *B65D 17/18* (2013.01); *B65D 17/50* (2013.01); *B65D 51/226* (2013.01); *B67B 7/24* (2013.01)

(58) Field of Classification Search

CPC ..... B65D 51/228; B65D 43/02; B65D 51/22; B65D 2251/0015; B65D 17/18; B65D 17/50; B65D 17/506; B65D 43/06; B65D 43/08; B67B 7/26; B67B 7/24

USPC ..... 220/277, 278, 258.4, 259.3; 222/81, 83; 206/222

See application file for complete search history.

(56) References Cited

U.S. PATENT DOCUMENTS

| | | | | |
|---|---|---|---|---|
| 6,279,779 | B1 * | 8/2001 | Laciacera et al. | 222/83 |
| 2011/0127266 | A1 | 6/2011 | Kasboske | |

FOREIGN PATENT DOCUMENTS

| | | | |
|---|---|---|---|
| JP | 2001-97378 | A | 4/2001 |
| JP | 2004-168318 | A | 6/2004 |

(Continued)

OTHER PUBLICATIONS

International Search Report dated Nov. 6, 2012 issued in corresponding application No. PCT/JP2012/074010.

*Primary Examiner* — Fenn Mathew
*Assistant Examiner* — James N Smalley
(74) *Attorney, Agent, or Firm* — Westerman, Hattori, Daniels & Adrian, LLP

(57) ABSTRACT

The purpose of the invention is to provide a very safe opener cap that can easily open a film serving as a section to be opened without scattering the contents. A can body (10) and a screw cap (20) are screwed together, and the screw cap (20) and an opener (30) are ratcheted together so as to rotate as a unit in the direction of the screw cap (20) tightening. Blade angles of an annular blade (34) are configured so that the blade angle in the direction of the screw cap (20) loosing is gentler than the blade angle in the direction of tightening.

7 Claims, 7 Drawing Sheets

(56) References Cited

FOREIGN PATENT DOCUMENTS

| | | | |
|---|---|---|---|
| JP | 2005-231640 | A | 9/2005 |
| JP | 2005-329957 | A | 12/2005 |
| JP | 2006-27732 | A | 2/2006 |
| JP | 2010-30620 | A | 2/2010 |
| JP | 2011-195143 | A | 10/2011 |
| WO | 95-19931 | A1 | 7/1995 |
| WO | 2010/010968 | A1 | 1/2010 |

* cited by examiner

OPENER CAP

TECHNICAL FIELD

The present invention relates to a cap having an opener for opening a container sealed by a multilayer film or the like, including an aluminum foil layer, and also for maintaining sealing after the opening of the container, and more particularly to a highly safe opener cap that can easily open a film at a section to be opened without scattering the contents of the container.

BACKGROUND ART

Containers (cans) for storing, for example, coffee beans and ground coffee are recapped many times with over-caps for repeated use. Among such cans, there is known a can in which a section to be opened of a can upper lid is partitioned by an annular curled section and the inner side of the annular curled section is tightly sealed from a can lid rear surface by a gas barrier multilayer synthetic resin film including an aluminum foil layer. As a method of cutting and opening the film of the upper lid of such a can, there is known a method of cutting based on a screw configured such that a female screw is formed on the inner circumferential surface of a lower part of an over-cap and a male screw is formed on the outer circumferential surface of an upper part of a can main body, a cutter in a folded state is mounted on a top plate rear surface of the over-cap, and the over-cap is screwed into the can main body after the cutter is raised up, whereby the over-cap is displaced downward while rotating and the cutter pierces into and cuts the film in a circular shape (see, for example, Patent Document 1). In such an over-cap opener of the screw type, the cutter is mounted on the over-cap in the folded state and needs to be raised up by a fingertip when the can is opened. After being raised up once, the cutter is always in a projected state from the top plate rear surface of the over-cap. Therefore, there is a risk that a user's finger is cut when the user opens and closes and uses the over-cap.

There is also proposed open cap openers in which an opener configured by an annular cutter having an annular blade is formed separately from an over-cap and the annular cutter for cutting, in opening a film, the film in a circular shape by gripping the opener by fingers, directly piercing the annular blade into a film, and directly rotating the opener in that state and a crowned over-cap are combined (see, for example, Patent Documents 2 and 3). Among such open cap openers by the annular cutter, the open cap opener described in Patent Document 2 is an open cap opener of a type in which, after the film opening, the opener is housed on the inner side of the over-cap in a posture in which the annular blade faces the top plate rear surface of the over-cap. The open cap opener described in Patent Document 3 is an open cap opener of a type in which the opener is not housed on the inner side of the over-cap after the film cutting and, after the film is cut, the film is left in a state in which the opener is fit in the annular curled section of the can upper lid (i.e., a state in which the annular blade faces the inside of the can main body). In the open cap openers, since the annular blade is not exposed to the outside after the opening, it is possible to eliminate the risk that the finger is cut by the annular blade when the over-cap is removed from the can main body.

PRIOR ART

Patent Document

Patent Document 1: Japanese Patent Application Laid-Open No. 2004-168318

Patent Document 2: Japanese Patent Application Laid-Open No. 2006-27732

Patent Document 3: Japanese Patent Application Laid-Open No. 2010-30620

DISCLOSURE OF THE INVENTION

Problem to be Solved by the Invention

In all the open cap openers in the past, the opening by the annular cutter (the opener) is performed by gripping the opener itself by fingers, pushing the annular blade into the film, and then rotating the annular blade to cut a film piece in a circular shape to open the film. However, a gripping section of the opener has only an outer diameter as small as the annular curled section of the can upper lid. Therefore, there is a problem in that a portion gripped by the user is insufficient, it is hard to apply force to the opener, and, as a result, it is hard to perform opening operation for the film. If the container is a coffee beans/ground coffee can or the like and is a so-called positive pressure can in which an inert gas is filled for oxidation prevention for contents or a carbon dioxide gas emitted from coffee of the contents is also added and a can internal pressure is set higher than the atmospheric pressure, there is a problem in that, in the opening by the annular opener in the past, when the annular blade of the opener is pushed into the film, the inert gas blows out and the contents scatter to the outside.

Therefore, the present invention has been devised in view of such problems of the related art and it is an object of the present invention to provide a highly safe opener cap that is easily gripped and easily loosened and can easily open a film in a section to be opened without scattering contents.

Means for Solving Problem

In order to attain the object, an opener cap recited in claim 1 includes a combination of a semi-conical or cylindrical screw cap including a female screw to be joined with a male screw formed in a side-surface upper part of a can main body and an opener including an annular blade for cutting a film serving as a section to be opened formed in an upper lid of the can main body, the opener being formed to remain in the opening of the upper lid after opening of the film. At an opening end of a cylinder rib formed on a top plate rear surface of the screw cap and an opening end of the opener on the opposite side of the annular blade, upper ratchet teeth and lower ratchet teeth meshing with each other only in a tightening direction of the screw cap are respectively formed.

In the opener cap, the screw cap and the opener configure a ratchet joint that integrally rotates and descends only in the cap tightening direction, that is, a direction in which the screw cap is screwed into the can main body.

Therefore, unlike a mechanism for rotating the annular cutter (the opener) alone to open the film in the past, the annular blade of the opener cuts the film of the can upper lid while piercing into the film to form an opening in the can upper lid.

In the opener cap recited in claim 2, the upper ratchet teeth and the lower ratchet teeth mesh with each other subsequent to the start of meshing of the female screw of the screw cap and the male screw of the can main body.

In the opener cap recited in claim 3, the upper ratchet teeth of the screw cap and the lower ratchet teeth of the opener are formed in a relation in which the upper ratchet teeth and the lower ratchet teeth can come into contact with each other over entire circumferences thereof.

In the opener cap recited in claim 4, a maximum envelope diameter of the opener is set slightly smaller than a minimum inner diameter of ridge sections of the female screw of the screw cap.

In the opener cap recited in claim 5, the annular blade of the opener is an asymmetrical blade, a blade angle of which in a loosening direction of the screw cap is set smaller than a blade angle in a tightening direction of the screw cap.

Effects of the Invention

In the opener cap of the present invention recited in claim 1, the can main body and the screw cap are joined by screws and the screw cap and the opener configure the ratchet joint that integrally rotates only in the tightening direction of the screw cap. Therefore, simply by screwing the screw cap into the can main body in the opening operation for the film, the opener cuts the film of the can upper lid in a circular shape. Therefore, in the opening operation, since a gripping portion of the user is the screw cap, it is possible to secure the gripping portion and a rotation radius larger than a gripping portion and a rotation angle in turning the opener alone in the past. It is easy to apply force to the screw cap in turning the screw cap. It is easy to perform opening operation for the film.

Further, the opening operation for the film is performed in a state in which the screw cap is put over the can upper lid. Therefore, contents do not scatter to the outside of the screw cap when the film is opened.

Further, the opener remains in the opening of the can upper lid after the film opening. However, since both the ratchet teeth do not mesh with each other in the loosening direction of the screw cap, even when a user removes the screw cap from the can main body, the opener does not come off the can main body. Therefore, the opener remains in the opening of the can lid in a posture in which the blade is always directed to the inside of the can main body and covers a cutting blade of the film. Therefore, the opener cap is safe because the risk of cutting the user's finger during use of the opener decreases.

According to the invention recited in claim 2, since the screw cap and the opener configure the ratchet joint with a delay after the start of the screw fastening of the screw cap to the can main body, in addition to the effect explained above, first, the screw cap and the can main body are joined by screws, whereby an axis of the screw cap serving as a reference when the opener opens the film is determined. The screw cap and the opener are joined by ratchets with a delay, whereby an axis of the opener is determined. Consequently, centering of the opener is suitably performed simply by screwing the screw cap into the can main body. The opening of the film by the opener is stably and accurately performed.

Further, according to the invention recited in claim 3, since the ratchet joint is configured such that the ratchet teeth come into contact with each other over the entire circumference, it is possible to stably perform the opening operation for the film. In addition, by screwing the screw cap into the can main body, the ratchet joint section and a joined section of the opener and the opening of the can upper lid function as sealing sections to seal the can main body. Consequently, after the film opening, sealability (resealability) of the can main body is retained. As a result, for example, even when the can turns over, the contents do not spill over the can lid.

Further, according to the invention recite in claim 4, the maximum envelope diameter of the opener is configured to be slightly smaller than the minimum inner diameter of the ridge sections of the female screw of the screw cap. Consequently, even when the axis of the opener is set to deviate from the axis of the screw cap, any one of the (screw) ridge sections of the female screw of the screw cap hits a protruding part of the opener, whereby the deviation of the axis of the opener is corrected. The opener acts to return the axis to a correct position.

According to the invention of claim 5, since the blade angle of the annular blade of the opener on the opposite side of the tightening direction is set small, the blade in the loosening direction (the rear blade) traces and closes a cut end of the film cut by the blade in the tightening direction (the front blade). In the film opening operation, scattering of the contents to the outside is suitably suppressed. Since the blade is the asymmetrical blade, as a result, the blade is long in the circumferential direction and there is a margin in strength. Therefore, even if the blade is reduced in thickness, the original strength is retained. That is, it is possible to reduce the thickness of the blade to improve cutting properties and reduce an amount of use of a material.

BRIEF DESCRIPTION OF THE DRAWINGS

FIGS. 2A and 2B show a screw cap according to the embodiment of the present invention, wherein FIG. 2A is a sectional view and FIG. 2B is a bottom view.

FIGS. 3A to 3C show an opener according to the embodiment of the present invention, wherein FIG. 3A is a plan view, FIG. 3B is an A-A sectional view of FIG. 3A, and FIG. 3C is a front view.

EXPLANATION OF REFERENCE NUMERALS

Figure 1:
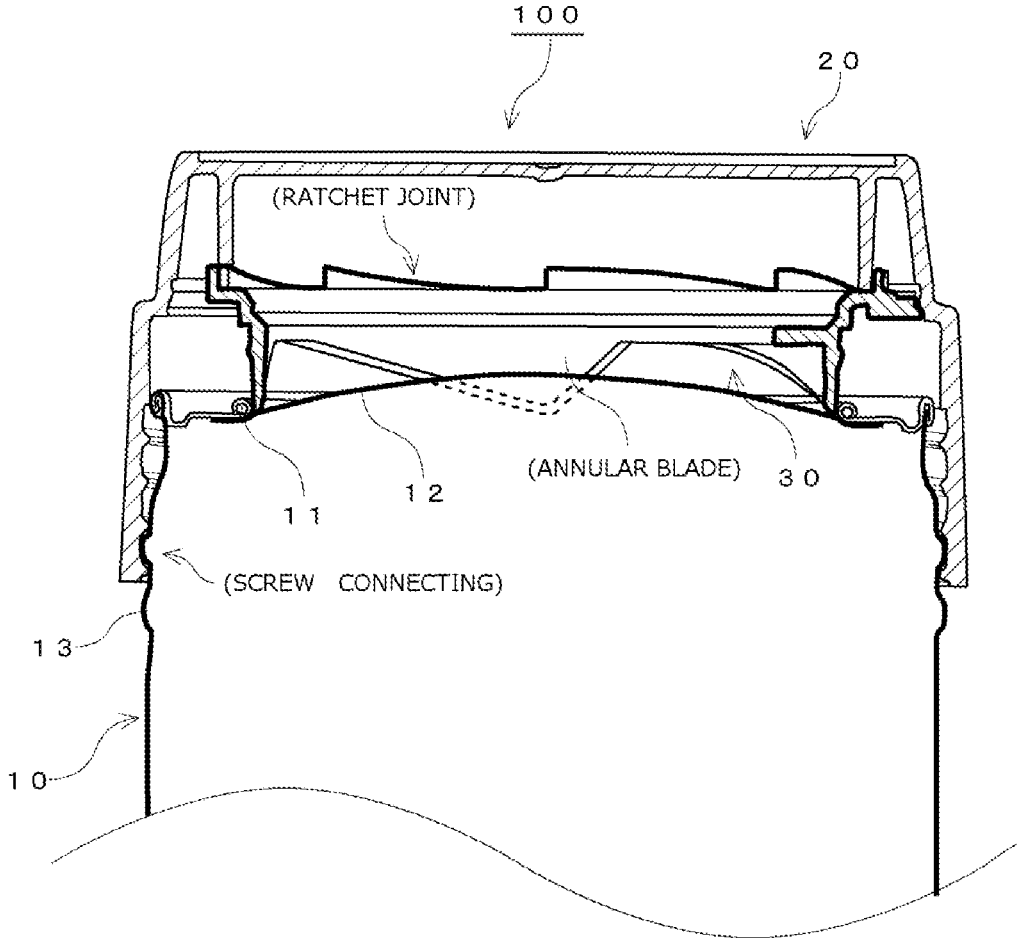
FIG. 1 is a sectional explanatory diagram at the time when an opener cap according to an embodiment of the present invention is attached to a can main body and opening is started.

10 Can main body
11 Annular curled section
12 Film
13 Male screw
20 Screw cap
21 Cylinder rib
22 Upper ratchet teeth
23 Female screw
24 Opener fitting annular groove
25 Opener contact taper surface
30 Opener
31 Cap fitting projections
32 Lower ratchet teeth
33 Finger hook section
34 Annular blade
35 Step surface
36 Can fitting projection
37 Cap fitting recess
100 Opener cap

BEST MODE FOR CARRYING OUT THE INVENTION

The present invention is explained more in detail below with reference to an embodiment shown in the figures.

FIG. 1 is a main part sectional explanatory diagram showing an opener cap 100 according to an embodiment of the present invention. Note that this figure shows a state immediately before an opener 30 opens a film 12 of a can main body 10 (immediately before film opening).

The opener cap 100 of the present invention is configured by: a screw cap 20 configured to be fastened to the can main body 10 by screws to repeatedly cover resealably an entire upper lid of the can main body 10 and joined to the opener 30 by ratchets to transmit a rotation force of a user to the opener 30 in the film opening, and, after the film opening, cooperate with the opener 30 to display a seal function; and the opener 30 configured to be joined to the screw cap 20 by ratchets and cut the film 12 of the can main body 10 in a circular shape while integrally rotating and descending in the film opening and, after the film opening, lock to and remain in an opening (an annular curled section 11) of the can upper lid.

The configuration of the can main body 10 is not specifically limited. However, in this embodiment, the can main body 10 is a three-piece can formed by a can lid, a can body, and a can bottom (not shown in the figure). The can lid and the can body or the can bottom and the can body are respectively doubly wound and tightened and hermetically joined at the circumferential end. The can main body 10 is a so-called positive pressure can. An inert gas (e.g., a nitrogen gas or a carbon dioxide gas) is encapsulated for oxidization prevention for contents. The internal pressure of the can main body 10 is set slightly higher than the atmospheric pressure. An inner side portion (a section to be opened) of the annular curled section 11, which is an opening of the can upper lid, is tightly sealed from the rear surface of the can upper lid by a gas barrier multilayer synthetic resin film (the film 12) including an aluminum foil layer. The film 12 is swelled in a dome shape by the inert gas in the inside. As explained below, the user screws the screw cap 20 into the can main body 10, whereby the opener 30 joined with the screw cap 20 by ratchets in a tightening direction integrally rotates and descends. The film 12 is cut in a circular shape by an annular blade of the opener 30.

A male screw 13 joining with a female screw of the screw cap 20 is formed on an upper outer circumferential surface of the can main body 10. Therefore, the screw cap 20 is turned in the clockwise direction (the screw tightening direction) viewed from above, whereby the screw cap 20 is displaced downward while maintaining the axis of the screw cap 20 fixed with respect to the can main body 10. As a result, as explained below, the opener 30 joined by ratchets in the tightening direction also rotates integrally with the screw cap 20 and is displaced downward while maintaining the axis of the opener 30 fixed. The opener 30 pierces into the film 12 and cuts the film 12 in a circular shape. In this way, the user screws the screw cap 20 into the can main body 10, whereby centering of the opener 30 during the film opening is suitably performed. The opening of the film 12 by the opener 30 is stably and accurately performed.

Figure 2:
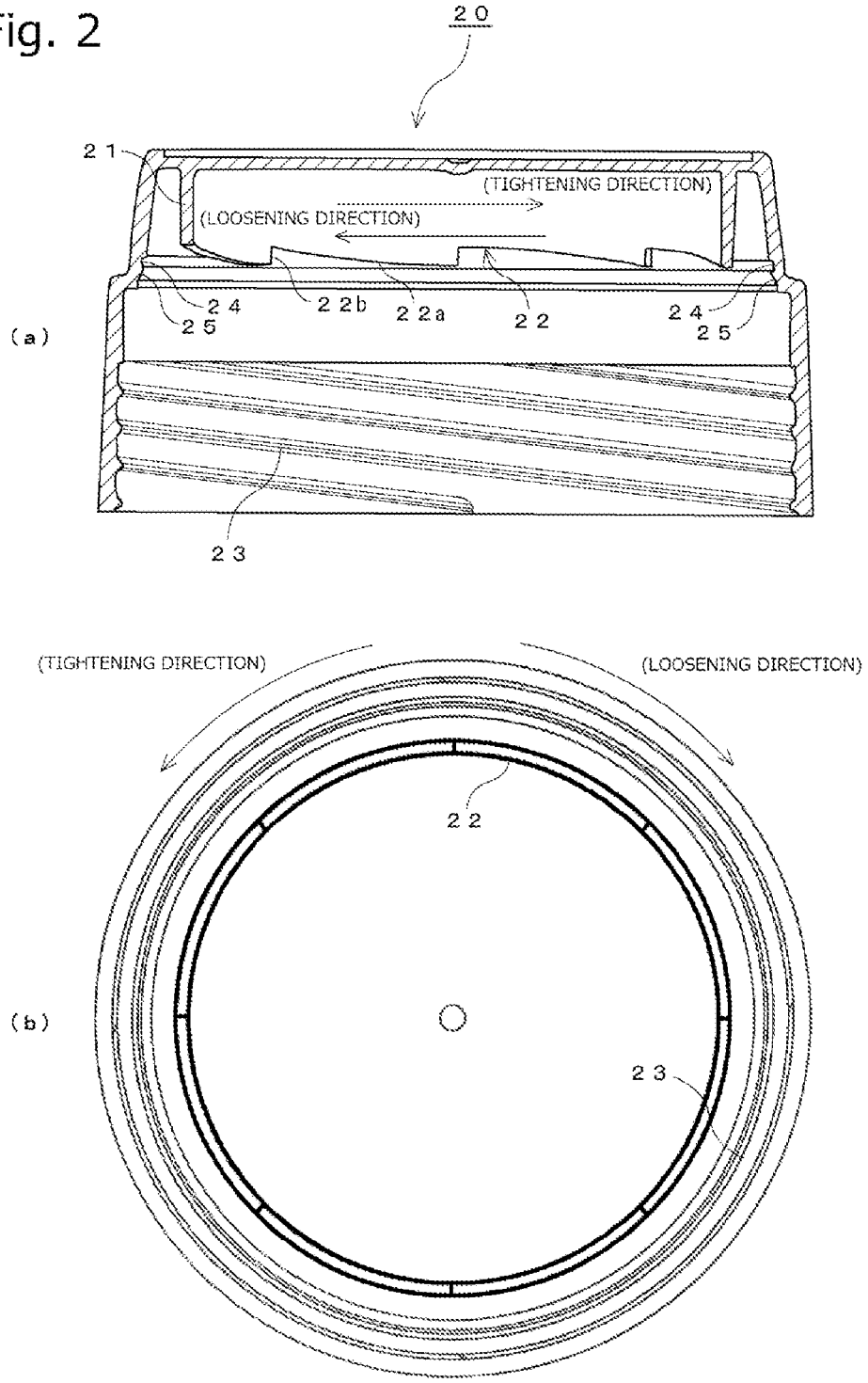

FIGS. 2A and 2B are explanatory diagrams showing the screw cap 20 according to the embodiment of the present invention.

As shown in FIG. 2A, a cylinder rib 21 is formed on a top plate rear surface of the screw cap 20. Upper ratchet teeth 22, which engage with lower ratchet teeth 32 of the opener 30 explained below, are formed at an opening end of the cylinder rib 21. A female screw 23, which joins with the male screw 13 of the can main body 10, is formed on a lower inner circumferential surface of the cylinder rib 21.

Figure 4:
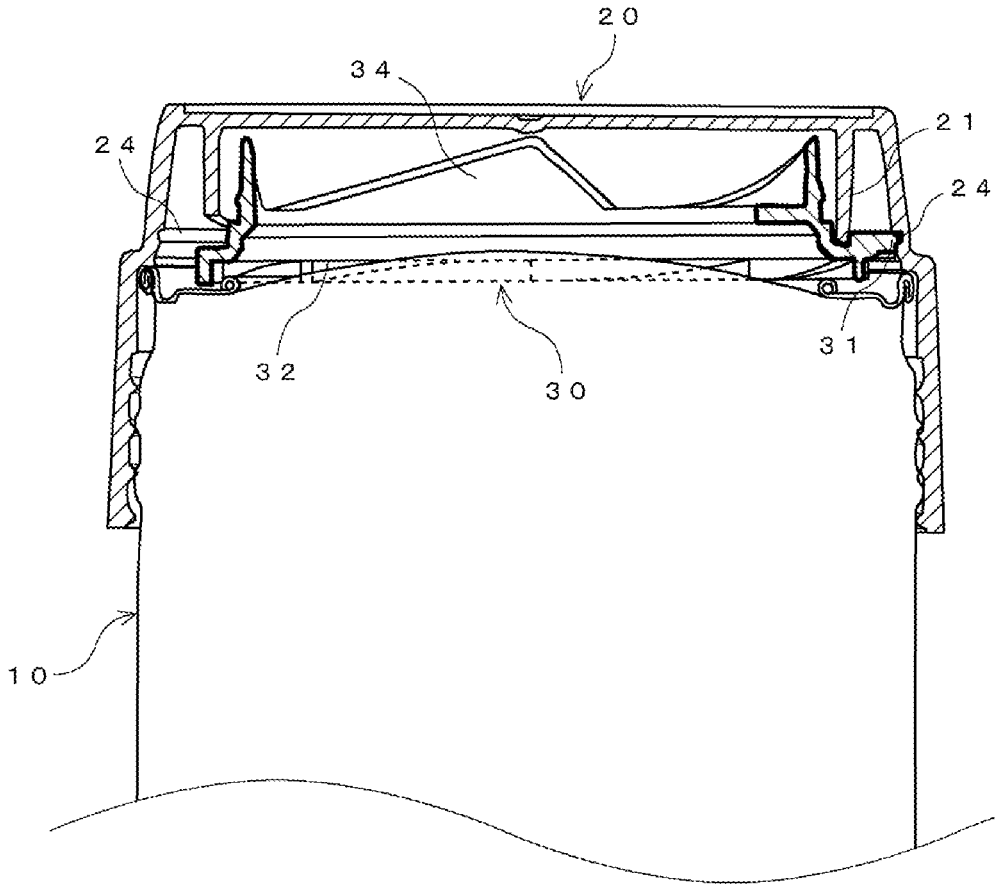
FIG. 4 is a sectional explanatory diagram in a factory shipment time (unused) state in which the opener cap according to the embodiment of the present invention is attached to the can main body.

An opener fitting annular groove 24 for safely housing and locking the opener 30 in the cap in a reversed state before use (during factory shipment) is formed on an upper inner circumferential surface of the cylinder rib 21 (see FIG. 4). An opener contact taper surface 25, with which the opener 30 comes into contact upon film opening, is formed below the opener fitting annular groove 24 (see FIG. 1). The opener contact taper surface 25 stabilizes the ratchet joint of the screw cap 20 and the opener 30 when the screw cap 20 is screwed into the can main body 10.

In the upper ratchet teeth 22, the ratchet teeth are formed by inclined surfaces 22*a* and vertical surfaces 22*b*. In this embodiment, as shown in FIG. 2B, the upper ratchet teeth 22 are formed by eight ratchet teeth. When the screw cap 20 rotates in the clockwise direction (the tightening direction), the vertical surfaces 22*b* mesh with vertical surfaces 32*b* of the lower ratchet teeth 32 of the opener 30 and the screw cap 20 and the opener 30 integrally rotate. On the other hand, when the screw cap 20 rotates in the counterclockwise direction (a loosening direction), the inclined surfaces 22*a* and inclined surfaces 32*a* of the lower ratchet teeth 32 of the opener 30 slip on each other. The screw cap 20 and the opener 30 do not integrally rotate.

The upper ratchet teeth 22 come into contact with the lower ratchet teeth 32 of the opener 30 over the entire circumference of the cylinder rib 21. The upper ratchet teeth 22 suitably prevent the contents from spilling from the can main body 10 after the film opening in conjunction with a joined section (see FIG. 7) of the opener 30 and the annular curled section 11.

Figure 3:
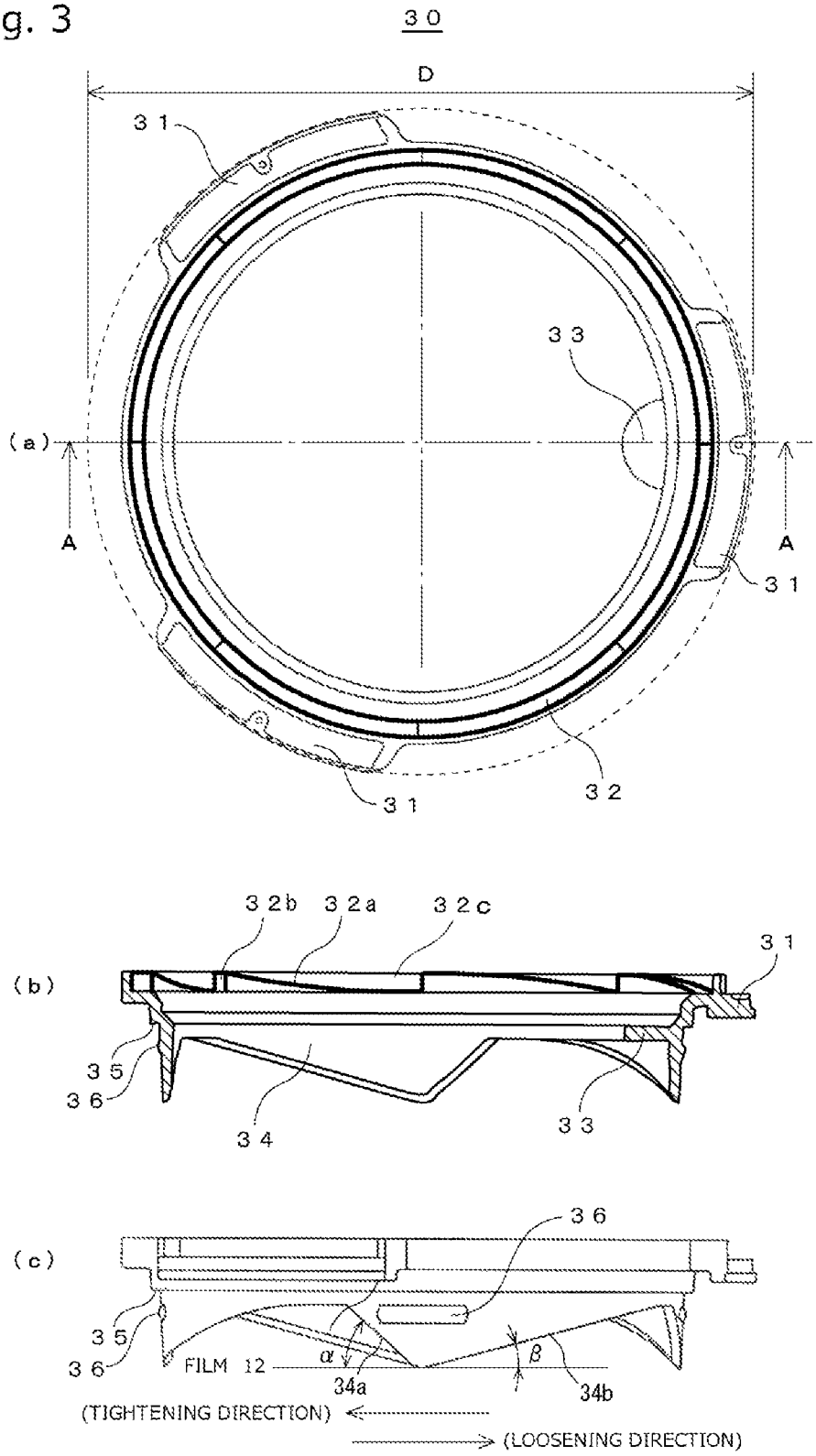

FIGS. 3A to 3C are explanatory diagrams showing the opener 30 according to the embodiment of the present invention.

As shown in FIG. 3A, cap fitting projections 31, which fit with the screw cap 20, are formed in three places of an outer circumferential end. Before use (during the factory shipment), the cap fitting projections 31 fit in the opener fitting annular groove 24 of the screw cap 20 in an upside down state of the opener and suitably stabilize the posture of the opener 30 in housing the opener 30 in the inside of the screw cap 20. On the other hand, during the film opening, the cap fitting projections 31 come into contact with the opener contact taper surface 25 of the screw cap 20 and suitably stabilize the ratchet joint of the opener 30 and the screw cap 20 in screwing the screw cap 20 into the can main body 10.

As shown in FIG. 3B, lower ratchet teeth 32, which engage with the upper ratchet teeth 22 of the screw cap 20, are formed on one side of an opening end of the opener 30 (an upper side during the opening operation). Note that, like the upper ratchet teeth 22 of the screw cap 20, the lower ratchet teeth 32 are formed by the inclined surfaces 32*a* and the vertical surfaces 32*b*. The lower ratchet teeth 32 are formed by eight ratchet teeth. In the ratchet joining, all the inclined surfaces 32*a* and all the vertical surfaces 32*b* are configured to come into contact with all the inclined surfaces 22*a* and all the vertical surfaces 22*b* of the upper ratchet teeth 22 of the screw cap 20. In this embodiment, eight lower ratchet teeth 32 and eight upper ratchet teeth 22 are formed. However, the number of the lower ratchet teeth 32 and the upper ratchet teeth 22 is not limited to eight. An arbitrary number can be adopted.

At the opening end of the opener 30, as shown in FIG. 3B, a circumferential wall 32*c* having height same as the height of the lower ratchet teeth is provided in contact with the outer circumference of the eight lower ratchet teeth 32. The circumferential wall 32*c* plays a function for guiding tooth tips of the upper ratchet teeth 22 when meshing with the upper ratchet teeth 22 and a function of assisting sealing from the side surface when the upper ratchet teeth 22 and the lower ratchet teeth 32 come into contact with each other over the entire circumference.

The circumferential wall 32*c* has action of, for example, reducing a risk of cutting a finger in the lower ratchet teeth 32 in a state in which the opener 30 is housed in the screw cap 20 in an inverted state and a state in which the opener 30 fits in the can upper lid opening after the film opening.

In a part on the opposite side (the inner diameter side) of one cap fitting projection 31, a finger hook section 33 for facilitating the user to take out the opener 30 in a locked state from the inside of the can upper lid or the screw cap 20 may be formed.

An annular blade 34 is formed at the opening end on the opposite side of the lower ratchet teeth 32 (on the lower side during the opening operation) and, at the same time, a step surface 35 is formed with respect to the radial direction. As shown in FIG. 3C, the annular blade 34 is asymmetrical blade configured in a relation of $\alpha>\beta$ such that a blade angle $\alpha$ in the tightening direction of the screw cap 20 with respect to the film 12 of the can upper lid is larger than a blade angle $\beta$ in the loosening direction. By configuring the annular blade 34 in this way, a rear blade 34*b* of the annular blade 34 closes a cut end during cutting of the film 12 by a front blade 34*a* of the annular blade 34 while tracing the cut end. Scattering of the contents is suitably suppressed. Note that, as an example of the blade angles $\alpha$ and $\beta$, $\alpha$ is about 45° and $\beta$ is about 15°.

As explained below with reference to FIG. 7, a can fitting projection 36 for fitting with the annular curled section 11 of the can main body 10 after the film opening is formed on the outer circumferential surface of the annular blade 34.

As shown in FIG. 3A, a maximum envelope diameter D of the opener 30 (the diameter of a circle circumscribing the cap fitting projections 31) is configured to be slightly smaller than a minimum inner diameter of ridge sections of the female screw 23 of the screw cap 20. A difference between the maximum envelope diameter D and the minimum inner diameter of the screw ridges is set to a degree not exceeding the diameter of a curl of the annular curled section 11, preferably, the radius of the curl. By configuring the maximum envelope diameter D in this way, even when the opener 30 is placed slightly deviating from the annular curled section 11 of the can upper lid, the opener 30 comes into contact with any one of the screw ridges of the female screw 23 of the screw cap 20 and is corrected to a correct position.

The opener cap in this embodiment is configured as explained above. Before the use (during the factory shipment), as shown in FIG. 4, the opener is housed in the screw cap with the annular blade thereof facing upward.

That is, the opener 30 is housed on the inner side of the screw cap 20 in a state in which the annular blade 34 is housed on the inner side of the cylinder rib 21 (an inverted posture of the opener 30). The screw cap 20 is fastened to the can main body 10 by screws. In this state, the cap fitting projections 31 of the opener 30 fit in the opener fitting annular groove 24 of the screw cap 20. The annular blade 34 of the opener 30 is housed on the inner side of the cylinder rib 21 of the screw cap 20. The upper ratchet teeth 22 at the opening end of the cylinder rib 21 of the screw cap 20 are protected by the opener 30. The lower ratchet teeth 32 facing downward in the inverted state are held at height where the lower ratchet teeth 32 do not come into contact with the can upper lid. Therefore, the annular blade 34 does not carelessly pierce into a film surface of the container. The opener is stably held in the screw cap.

A method of cutting and opening a film, which seals a container, using the opener cap according to this embodiment having the configuration explained above is explained in detail with reference to FIGS. 5 to 7.

Figure 5:
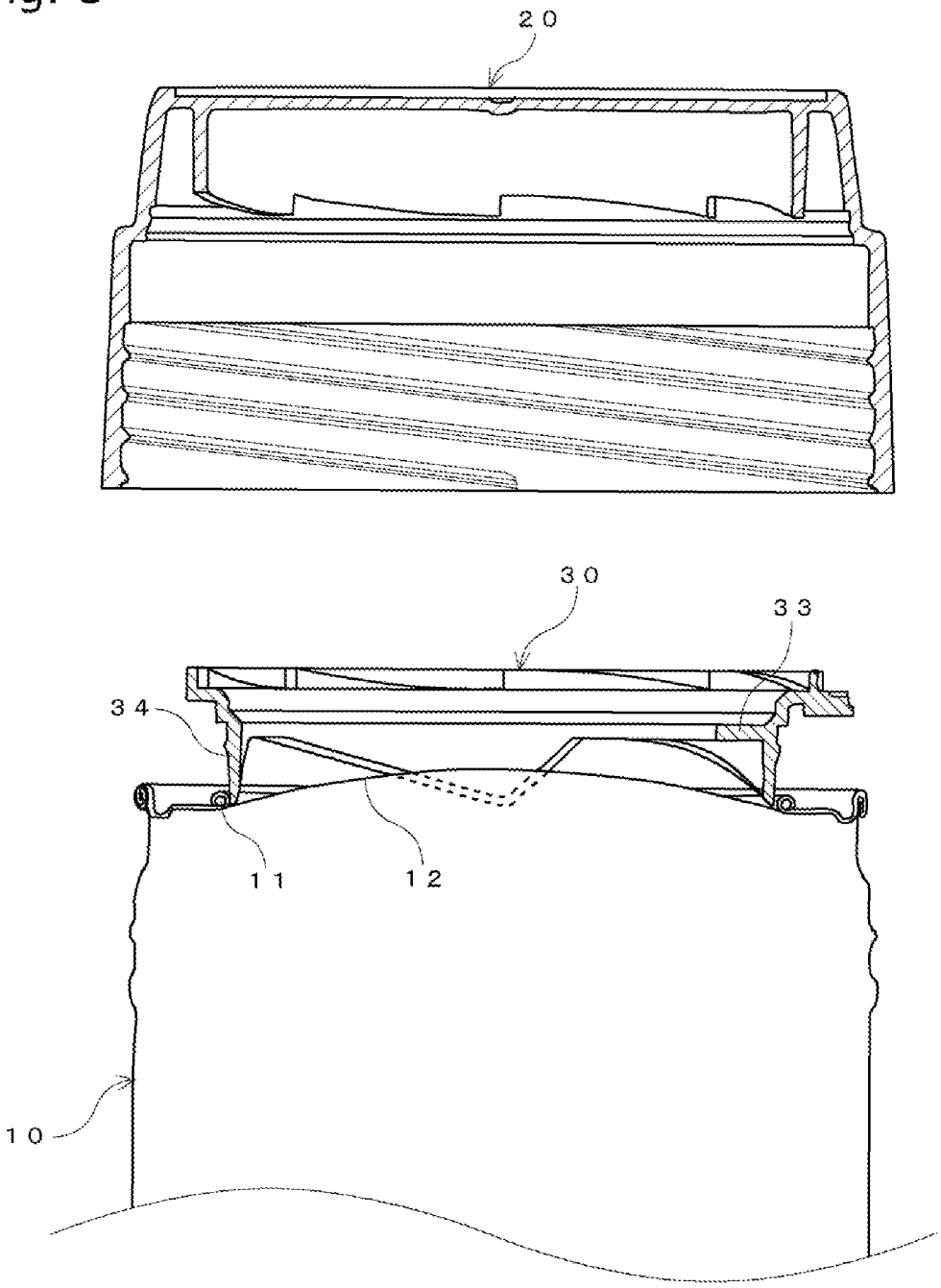
FIG. 5 is a sectional explanatory diagram showing an opener cap in a film opening operation process for a container.

FIG. 5 is a main part sectional explanatory diagram showing the opener cap 100 before the film opening.

The figure shows a state in which the screw cap 20 is loosened from the opener cap 100 in the state shown in FIG. 4 and separated from the can main body 10, subsequently, the opener 30 is taken out from the screw cap 20 using the finger hook section 33 of the opener 30, the opener 30 is reversed, and the opener 30 is placed on the film 12 of the can main body 10 such that the annular blade 34 is located in an inner side section (a section to be opened) of the annular curled section 11 of the can upper lid.

Figure 6:
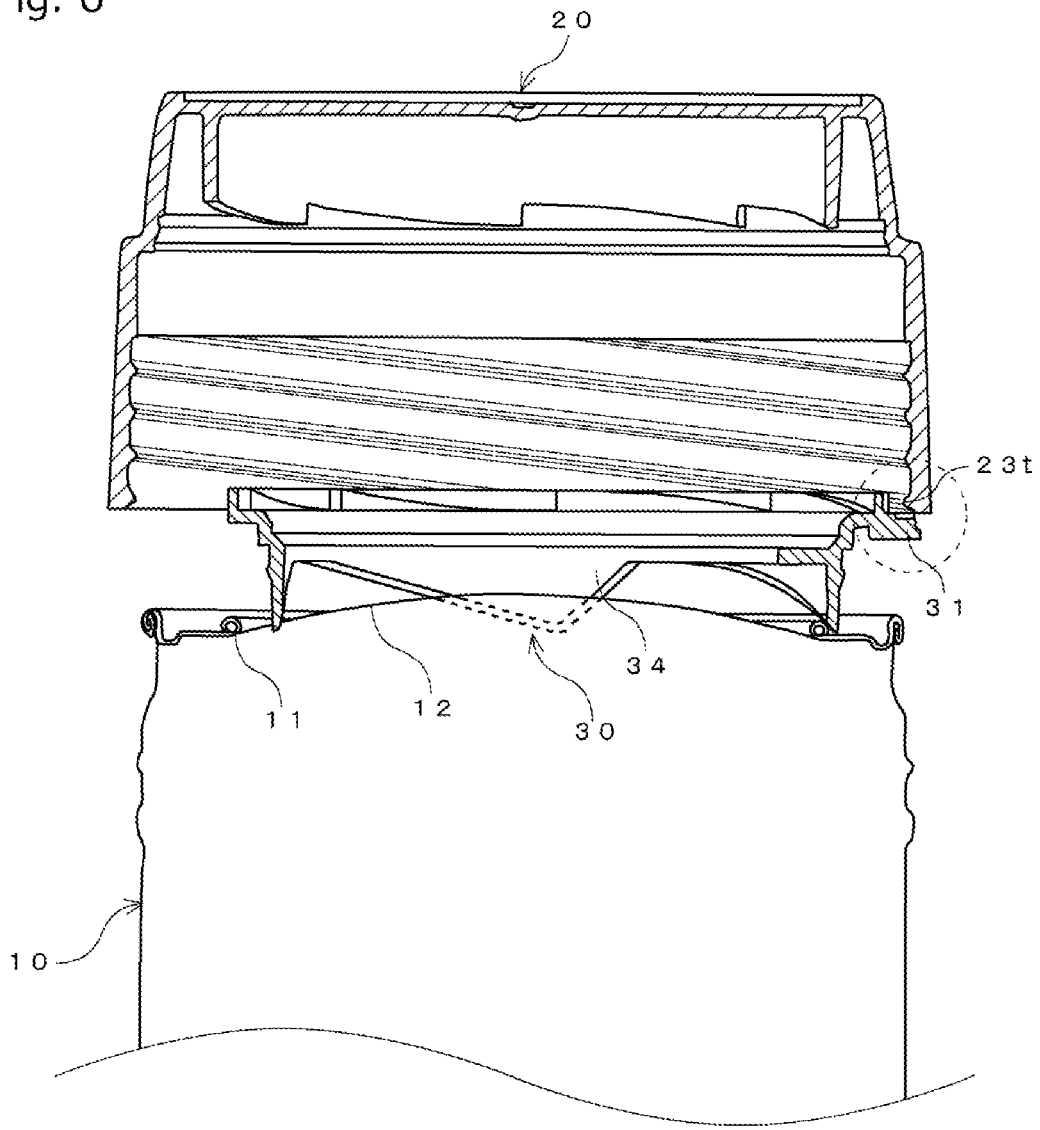
FIG. 6 is a sectional explanatory diagram showing correction of deviation of an axis with respect to the opener.

If the opener 30 is not correctly placed on the can upper lid, that is, when the axis of the opener 30 is attached deviating from the axis of the can main body 10, as shown in FIG. 6, the cap fitting projections 31 of the opener 30 come into contact with any one of screw ridges 23*t* of the female screw 23 of the screw cap 20. The opener 30 is returned to the center and the deviation of the axis of the opener 30 is corrected.

In a form shown in FIG. 1, the screw cap 20 is screwed into the can main body 10, whereby the opener 30, the deviation of the axis of which is corrected, joined to the screw cap 20 by ratchets integrally rotates and descends. The annular blade 34 cuts the film 12 of the can main body 10 in a circular shape.

Figure 7:
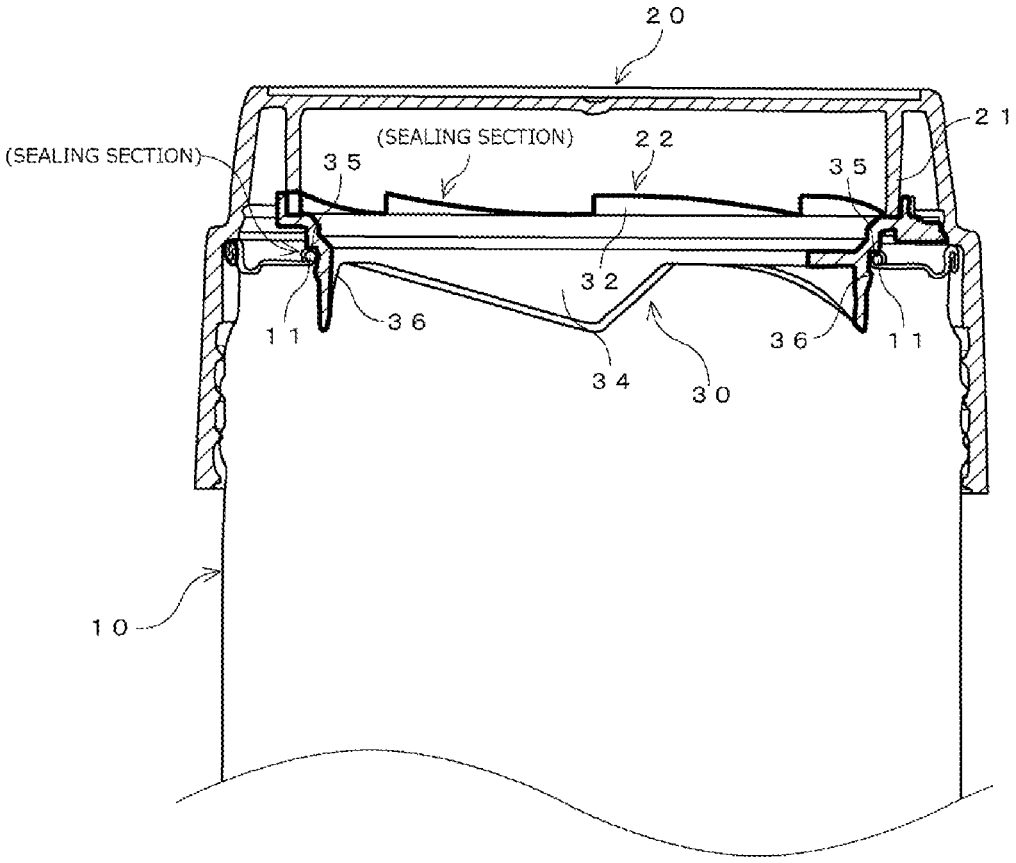
FIG. 7 is a sectional explanatory diagram showing the opener cap after film opening.

FIG. 7 is a main part sectional explanatory diagram showing the opener cap 100 after the film opening.

In this state, the opening of the film 12 of the can main body 10 by the opener 30 is completed. The opener 30 fits in the annular curled section 11 of the can upper lid via a recess formed by the step surface 35 and the can fitting projection 36. The annular blade 34 locks to the can upper lid in a state in which the annular blade 34 faces the inside of the can main body 10. As a result, the annular blade 34 covers a cutting blade of the film bonded to and remaining on the can lid rear surface of the can main body. Therefore, it is possible to reduce a risk of cutting a finger tip at the cutting blade and prevent the cutting blade from being exposed to the opening and interrupting the contents to be taken out.

The screw cap 20 is screwed into the can main body 10, whereby the screw cap 20 rotates and descends and compression-bonds a ratchet-joined section of the screw cap 20 and the opener 30 and, at the same time, compression-bonds a joined section of the annular curled section 11 of the can upper lid and the step surface 35 of the opener 30. Consequently, both the joined sections function as sealing sections and prevent the contents of the can main body 10 from spilling.

As explained above, in the opener cap 100, after the can main body 10 and the screw cap 20 are fastened by screws, the screw cap 20 and the opener 30 are joined by ratchets with a delay. In this way, the can main body 10 and the screw cap 20 are fastened by screws first, whereby the axis of the screw cap 20 serving as a reference in cutting of the film 12 by the opener 30 (during the film opening) is determined. Thereafter, the screw cap 20 and the opener 30 are joined by ratchets, whereby centering of the opener 30 in the film opening is suitably performed.

As it is evident from the figures, the ratchet joining of the screw cap 20 and the opener 30 is so-called entire circumference contact in which entire joining surfaces thereof are in contact with each other. Consequently, after the opener 30 opens the film remaining in the annular curled section 11, the screw cap 20 is tightened (screwed) into the can main body 10, whereby a ratchet contact portion of the screw cap 20 and the opener 30 also function as a sealing section in addition to the joined section (see FIG. 7) of the opener 30 and the annular curled section 11. Even when the can main body 10 turns over or inverts, the contents do not spill over the can upper lid. Note that, since the opener 30 remains on the can upper lid in a state in which the annular blade 34 faces the inside of the can main body 10 after the film opening, a risk that the user's finger is cut by the annular blade during use decreases.

The annular blade of the opener 30 is a so-called asymmetrical blade. A blade angle in the loosening direction of the screw cap 20 is gentle compared with a blade angle in the tightening direction. The blade angles of the annular blade are set asymmetrical in this way, whereby the rear blade closes a cut end by the front blade. Scattering of the contents is suitably suppressed.

Further, during the film opening when the annular blade cuts the film, the entire upper lid of the can main body 10 is covered by the screw cap 20. Therefore, the contents do not scatter to the outside of the can main body 10.

INDUSTRIAL APPLICABILITY

The opener cap of the present invention can be applied to various content filled containers as an over-cap for performing opening and resealing after the opening of a container such as a positive pressure can, a normal pressure can, or a negative pressure can, an opening of which includes a sealing film section. In particular, the opener cap of the present invention can be suitably applied to a positive pressure can in which an inert gas is filled and a section to be opened is sealed by a gas barrier film like a coffee beans/ground coffee can.

The invention claimed is:

1. An opener cap, comprising:

a screw cap including a female screw configured to be joined with a male screw formed in a side-surface upper part of a can main body, the screw cap including a cylinder rib projecting downward from a top plate rear surface of the screw cap and upper ratchet teeth formed at an opening end of said cylinder rib, the upper ratchet teeth projecting downward from said top plate rear surface, and an opener including an annular blade for cutting a film serving as a section to be opened and lower ratchet teeth formed at an opening end of the opener, the lower ratchet teeth projecting in an opposite direction from the annular blade, wherein the film seals an upper lid in which an opening of the can main body is formed, wherein the opener capable of being housed in the screw cap with the annular blade facing upward before use, and capable of remaining in the opening of the upper lid after opening of the film, wherein the upper ratchet teeth and the lower ratchet teeth mesh with each other only in a tightening direction of the screw cap, wherein the upper ratchet teeth comprise an inclined surface which faces substantially downward in an axial direction of the screw cap, wherein the lower ratchet teeth comprise an inclined surface which faces substantially upward in an axial direction of the opener, and wherein the inclined surface of the upper ratchet teeth engages with the inclined surface of the lower ratchet teeth.

2. The opener cap according to claim 1, wherein the upper ratchet teeth and the lower ratchet teeth mesh with each other subsequent to the start of meshing of the female screw of the screw cap and the male screw of the can main body.

3. The opener cap according to claim 1, wherein the upper ratchet teeth of the screw cap and the lower ratchet teeth of the opener are formed in a relation in which the upper ratchet teeth and the lower ratchet teeth can come into contact with each other over entire circumferences thereof.

4. The opener cap according to claim 1, wherein a maximum envelope diameter of the opener is set slightly smaller than a minimum inner diameter of ridge sections of the female screw of the screw cap.

5. The opener cap according to claim 1, wherein the annular blade of the opener is an asymmetrical blade, a blade angle of which in a loosening direction of the screw cap is set smaller than a blade angle in a tightening direction of the screw cap.

6. The opener cap according to claim 2, wherein the upper ratchet teeth of the screw cap and the lower ratchet teeth of the opener are formed in a relation in which the upper ratchet teeth and the lower ratchet teeth can come into contact with each other over entire circumferences thereof.

7. The opener cap according to claim 1, wherein the upper ratchet teeth further comprise a vertical surface which extends substantially in the axial direction of the screw cap, wherein the lower ratchet teeth further comprise a vertical surface which extends substantially in the axial direction of the opener, wherein the vertical surface of the upper ratchet teeth engages with the vertical surface of the lower ratchet teeth.

* * * * *